US005421854A

United States Patent [19]

Kodas et al.

[11] Patent Number: 5,421,854

[45] Date of Patent: Jun. 6, 1995

[54] METHOD FOR MAKING PALLADIUM AND PALLADIUM OXIDE POWDERS BY AEROSOL DECOMPOSITION

[75] Inventors: Toivo T. Kodas, Albuquerque, N. Mex.; Shirley W. Lyons, San Carlos, Calif.; Howard D. Glicksman, Wilmington, Del.

[73] Assignees: E. I. Du Pont de Nemours and Company, Wilmington, Del.; University of New Mexico, Albuquerque, N. Mex.

[21] Appl. No.: 225,366

[22] Filed: Apr. 8, 1994

Related U.S. Application Data

[63] Continuation of Ser. No. 956,272, Oct. 5, 1992, abandoned.

[51] Int. Cl.[6] ..... B22F 9/24; C01G 55/00

[52] U.S. Cl. ..... 75/355; 75/359; 75/360; 75/369; 423/22; 423/592

[58] Field of Search ..... 75/355, 357–360, 75/363, 369, 370; 423/22, 592

[56] References Cited

U.S. PATENT DOCUMENTS

| | | | |
|---|---|---|---|
| 4,023,961 | 5/1977 | Douglas et al. | 75/355 |
| 4,396,420 | 8/1983 | Schmidberger et al. | 75/0.5 AC |
| 4,994,107 | 2/1991 | Flagan et al. | 75/367 |
| 5,250,101 | 10/1993 | Hidaka et al. | 423/592 |

FOREIGN PATENT DOCUMENTS

| | | |
|---|---|---|
| 0249366 | 5/1987 | European Pat. Off. . |
| 62-1807 | 1/1987 | Japan . |
| 62-2404 | 1/1987 | Japan . |

OTHER PUBLICATIONS

Nagashima et al., "Preparation of Fine Metal Particles from Aqueous Solutions of Metal Nitrate by Chemical Flame Method", Nippon Kagaku Kashi, No. 12, pp. 2293–2300, 1987.

Kato, et al., "Preparation of Silver Particles by Spray Pyrolysis Technique", Nippon Kagaku Zasshi, No. 12, pp. 2342–2344, 1985.

Chemical Abstracts, vol. 118, No. 18, May 3, 1993, Masuyuki, K., "Manufacture of fine-grained palladium powders", p. 169, col. 1, Abstract No. 171 954y & Japan Kokai Tokkyo Koho JP 04,333,503.

Chemical Abstracts, vol. 118, No. 18, May 3, 1993, Yasuo, I. et al., "Palladium powder for electronics application", p. 248, col. 2, Abstract No. 172 979x & Japan Kokai Tokkyo Koho JP 05 01,301.

*Primary Examiner*—George Wyszomierski

[57] ABSTRACT

A method for the manufacture of finely divided particles of palladium, palladium oxide or mixtures thereof comprising the sequential steps:

A. Forming an unsaturated solution of thermally decomposable palladium-containing compound in a thermally volatilizable solvent;

B. Forming an aerosol consisting essentially of finely divided droplets of the solution from step A. dispersed in an inert carrier gas;

C. Heating the aerosol to an operating temperature above the decomposition temperature of the palladium-containing compound, but below the melting point of palladium metal by which finely divided particles of palladium, palladium oxide or mixtures thereof are formed and densified; and D. Separating the particles of palladium, palladium oxide or mixtures thereof from the carrier gas, reaction by-products and solvent volatilization products.

8 Claims, 5 Drawing Sheets

METHOD FOR MAKING PALLADIUM AND PALLADIUM OXIDE POWDERS BY AEROSOL DECOMPOSITION

This is a continuation of application Ser. No. 07/956,272, filed Oct. 5, 1992, now abandoned.

FIELD OF INVENTION

The invention is directed to an improved process for making palladium and palladium oxide powders. In particular, the invention is directed to a process for making such powders that are fully dense with high purity and with spherical morphology.

BACKGROUND OF THE INVENTION

Precious metals including gold, silver, palladium, platinum, and their mixtures or alloys are used in the electronics industry for the manufacture of thick film paste.

Mixtures of palladium and silver are widely used in conductor compositions for hybrid integrated circuits. They are less expensive than gold compositions, are compatible with most dielectric and resistor systems and are suitable for ultrasonic wire bonding. The addition of palladium to silver greatly enhances the compatibility of the circuit for soldering, raises the melting point of the silver for compatibility with the dielectric firing temperatures and reduces the problems of silver migration which can cause degradation of the dielectric properties and shorting.

Palladium or palladium alloys are used in electrode materials for multilayer ceramic capacitors (MLCs). The properties of the metallic components of thick film inks intended for the internal electrodes of multilayer ceramic capacitors are extremely important because compatibility is required between the metal powder and the organic medium of an ink and between the ink itself and the surrounding dielectric material of the MLC. Pd powders suitable for use in multilayer ceramic capacitors must also be deagglomerated to adequately disperse in the organic medium and low in surface area to minimize low temperature sintering.

Printed circuit technology is requiring denser and more precise electronic circuits. To meet these requirements, the conductive lines have become more narrow in width with smaller distances between lines. This is especially true where multilayer ceramic capacitors are requiring thinner and narrower electrodes. The metal powders necessary to form dense, closely packed, narrow lines must be as close as possible to monosized, smooth spheres. The conductive metal powders must have a small particle diameter, an even grain size and a uniform composition.

Palladium oxide has not been widely used in electronic applications because of the inability to make smooth, dense, spherical palladium oxide particles.

Many methods currently used to manufacture metal powders can be applied to the production of palladium and palladium oxide powders. Chemical reduction methods, physical processes such as atomization or milling, thermal decomposition and electrochemical processes can be used. Palladium powders used in electronic applications are generally manufactured using chemical precipitation processes.

Palladium salts such as chloropalladous acid or palladium nitrate are used as starting materials for chemically precipitating palladium powder and palladium oxide. Palladium oxide is chemically produced by solution hydrolysis by increasing the pH of an acidic palladium salt solution until the palladium hydroxide is precipitated. This material then is converted to palladium oxide through dehydrolysis and drying. This process is hard to control and tends to give irregular-shaped, agglomerated particles.

Palladium oxide can also be produced through oxidation of palladium powder in air at high temperatures. Powders produced by this method are very non-uniform with low density.

In making palladium powder, a palladium salt is reduced by using reducing agents such as hydrazine, formaldehyde, hyposphorous acid, hydroquinone, sodium borohydride, formic acid and sodium formates. Metal powders prepared by the chemical reduction of simple metal salts tend to be hard to control, vary in surface area, irregular in shape and agglomerated.

The aerosol decomposition process involves the conversion of a precursor solution to a powder. The process involves the generation of droplets, transport of the droplets with a gas into a heated reactor, the removal of the solvent by evaporation, the decomposition of the salt to form a porous solid particle, and then the densification of the particle to give fully dense, spherical pure particles. Conditions are such that there is no interaction of droplet-to-droplet or particle-to-particle and there is no chemical interaction of the droplets or particles with the carrier gas.

The major problem that has limited successful application of the aerosol decomposition process for powder generation is lack of control over particle morphology. In particular, it was the requirement that the material must be treated above its melting point to form fully dense particles and that operation below the melting point tended to give impure, hollow-type particles which were not densified.

SUMMARY OF THE INVENTION

The invention is therefore directed to a method for the manufacture of finely divided particles of palladium, palladium oxide or mixtures thereof comprising the sequential steps:

A. Forming an unsaturated solution of thermally decomposable palladium-containing compound in a thermally volatilizable solvent;

B. Forming an aerosol consisting essentially of finely divided droplets of the solution from step A dispersed in an inert carrier gas, the droplet concentration being below the concentration at which coagulation results in a 10% reduction in droplet concentration;

C. Heating the aerosol to an operating temperature above the decomposition temperature of the palladium-containing compound but below the melting point of palladium by which (1) the solvent is volatilized, (2) the palladium-containing compound is decomposed to form finely divided particles of palladium, palladium oxide or mixtures thereof and (3) the particles are densified; and D. Separating the particles of palladium, palladium oxide or mixtures thereof from the carrier gas, reaction byproducts and solvent volatilization products.

DEFINITIONS

As used herein with respect to the solvent for the palladium-containing compound, the term "volatilizable" means that the solvent is completely converted to vapor or gas by the time the highest operating temperature is reached, whether by vaporization and/or by decomposition.

As used herein with respect to palladium-containing compounds, the term "thermally decomposable" means that the compound becomes fully decomposed to palladium metal, palladium oxide or mixtures thereof and volatilized by-products by the time the highest operating temperature is reached. For example, $Pd(NO_3)_2$ is decomposed to form $NO_x$ gas and Pd and/or PdO.

PRIOR ART

Kokai 62-2404 (JPA 60-139904) Asada et al.

The reference is directed to thick film pastes prepared from metal powders obtained by misting solutions of the metal salts and heating the mist at a temperature above the decomposition temperature of the metal salt. The reference discloses the use of the misting process for making "alloys". It is also disclosed that the mist must be heated at least 100C higher than the melting point of the desired metal or alloy.

Kokoku 63-31522 (Kokai 62-1807) (JPA 60-139903) Asada et al.

Production of metal powder by atomizing a solution containing metal salts(s) to produce liquid drops, heating the liquid drops to higher than the decomposition temperature of the salt, higher than the metal melting point and higher than the metal oxide decomposition temperature when the metal forms oxide at a temperature below the metal melting point to fuse decomposed metal grains.

U.S. Pat. No. 4,396,420

Spraying of mixed aqueous solution of silver and metal salts in a hot reactor at a wall temperature substantially above the temperature of disintegration of the salts but below the melting points of the individual compounds.

Nagashima et al, Preparation of Fine Metal Particles from Aqueous Solutions of Metal Nitrate by Chemical Flame Method, *Nippon Kagaku Kaishi*,12, 2293–2300

Fine metal particles were prepared by chemical flame method. When the flame temperature was lower than the melting point, the metal particles were non-spherical, when the flame temperature was sufficiently above the melting point of the metal, particles were formed via the melt and become perfectly spherical.

Kato et al, Preparation of Silver Particles by Spray Pyrolysis Technique, *Nippon Kagaku Zasshi*, No. 12:2342–4(1985)

The reference describes a study of the production of spherical, non-aggregated silver microparticles by spray pyrolysis. It is disclosed that particle surfaces were smooth at temperatures higher than the melting point of Ag (961C) and that particle diameter distribution increased as concentration of the reactants was increased. On the other hand, density of the particles dropped as the reaction temperature decreased below the melting point of Ag.

BRIEF DESCRIPTION OF THE DRAWING

The Drawing consists of five figures.

DETAILED DESCRIPTION OF THE INVENTION

Figure 1:
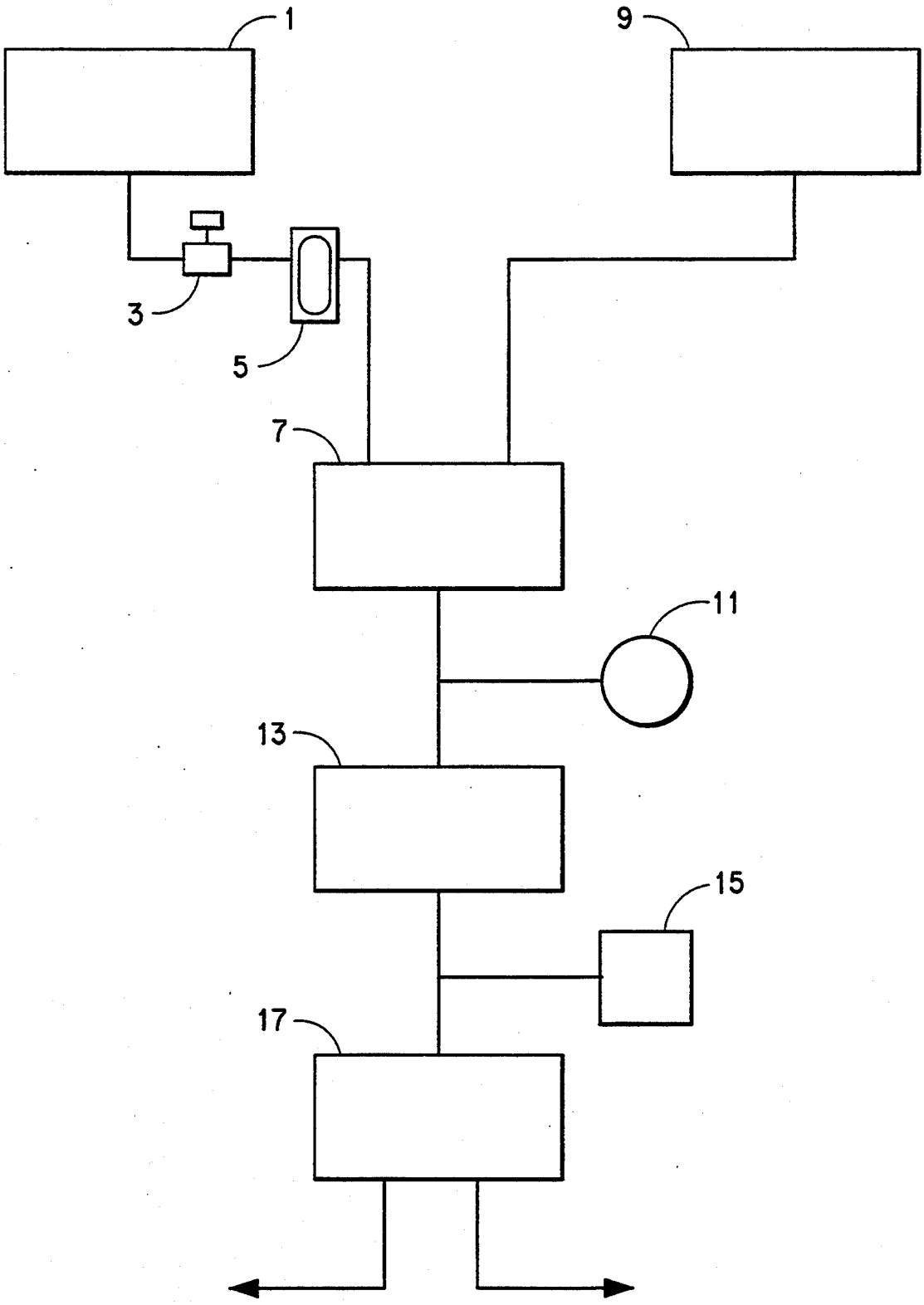
FIG. 1 is a schematic representation of the test apparatus with which the invention was demonstrated.

Palladium-Containing Compound: Any soluble palladium salt can be used in the method of the invention so long as it is inert with respect to the carrier gas used to form the aerosols. Examples of suitable salts are $Pd(NO_3)_2$, $Pd(SO_4)$, $Pd_3(PO_4)_2$ and the like. Insoluble palladium salts are not, however, suitable. The palladium salt may be used in concentrations as low as 0.2 mole/liter and upward to just below the solubility limit of the salt. It is preferred not to use concentrations below 0.2 mole/liter or higher than 90% of saturation.

While it is preferred to use water-soluble palladium salts as the source of palladium for the method of the invention, the method can nevertheless be carried out effectively with the use of other solvent-soluble palladium compounds such as organometallic palladium compounds dissolved in either aqueous or organic solvents.

Operating Variables: The method of the invention can be carried out under a wide variety of operating conditions so long as the following fundamental criteria are met:

1. The concentration of palladium compound in the aerosol must be below the saturation concentration at the feed temperature and preferably at least 10% below the saturation concentration in order to prevent precipitation of solids before removal of the liquid solvent;

2. The concentration of droplets in the aerosol must be sufficiently low that any coalescence of droplets which takes place in the reactor will not give more than a 10% reduction in droplet concentration;

3. The temperature of the reactor must be below the melting point of metallic palladium (1554C).

Though it is essential to operate under the saturation point of the palladium-containing compound, its concentration is not otherwise critical in the operation of the process. Much lower concentrations of palladium compounds can be used. However, it will ordinarily be preferred to use higher concentrations to maximize the amount of particles that can be made per unit of time.

Any of the conventional apparatus for droplet generation may be used to prepare the aerosols for the invention such as nebulizers, Collison nebulizers, ultrasonic nebulizers, vibrating orifice aerosol generators, centrifugal atomizers, two-fluid atomizers, electrospray atomizers and the like. The particle size of the powder is a direct function of the droplet sizes generated. The size of the droplets in the aerosol is not critical in the practice of the method of the invention. However, as mentioned above, it is important that the number of droplets not be so great as to incur excessive coalescence which broadens the particle size distribution.

In addition, for a given aerosol generator, concentration of the solution of palladium-containing compound has a direct effect on particle size. In particular, particle size is an approximate function of the cube root of the concentration. Therefore, the higher the palladium-containing compound concentration, the larger the particle size of the precipitated metal or metal oxide. If greater control over particle size is needed, a different aerosol generator must be used.

Virtually any vaporous material which is inert with respect to the solvent for the palladium-containing compound and with respect to the palladium-containing compound itself may be used as the carrier gas for the practice of the invention. Examples of suitable vaporous materials are air, nitrogen, oxygen, steam, argon, helium, carbon dioxide and the like. Of these, air and nitrogen are preferred.

The temperature range over which the method of the invention can be carried out is quite wide and ranges from the decomposition temperature of the palladium-containing compound up to, but below, the melting point of palladium (1554C). A unique feature of the method of the invention is that it can be used with equal facility for the production of finely divided particles of pure palladium metal, palladium oxide (PdO) as well as mixtures of palladium metal and palladium oxide.

In general, the distribution of metal and metal oxide in the powder product is a function of operating temperature. At lower operating temperatures below the decomposition temperature of PdO (870C), PdO predominates. Above the decomposition temperature of PdO, Pd metal predominates. The temperature at which the changeover between the two materials takes place depends in part upon the carrier gas used in the invention. For example, when the carrier gas is air, the decomposition of PdO takes place near its melting point (870C). The changeover from PdO to Pd metal is not complete until a temperature of about 900C is reached. On the other hand, when nitrogen is used as the carrier gas, the PdO decomposes and the Pd metal densities by the time the temperature reaches 800C.

The type of apparatus used to heat the aerosol is not by itself critical and either direct or indirect heating may be used. For example, tube furnaces may be used. It is an advantage of the method of the invention that the rate of heating the aerosol (and consequently the residence time as well) is not important from the standpoint of either the kinetics of the reactions or the morphology of the metal or metal oxide powders.

Upon reaching the reaction temperature and the particles are fully densified, they are separated from the carrier gas, reaction by-products and solvent volatilization products collected by one or more devices such as filters, cyclones, electrostatic separators, bag filters, filter discs, scrubbers and the like. The gas upon completion of the reaction consists of the carrier gas, decomposition products of the palladium-containing compound and solvent vapor. Thus, in the case of preparing palladium or palladium oxide from aqueous silver nitrate using $N_2$ as the carrier gas, the effluent gas from the method of the invention will consist of nitrogen oxide(s), water and $N_2$.

Test Apparatus: The experimental apparatus used in this work is shown schematically in FIG. 1. A source of carrier gas 1 supplies either $N_2$ or air through regulator 3 and flowmeter 5 to aerosol generator 7. Solution reservoir 9 supplies reaction solution to the aerosol generator 7 in which the carrier gas and reaction solution are intimately mixed to form an aerosol comprising droplets of the reaction solution dispersed in the carrier gas. The aerosol produced in generator 7 is passed to reactor 13, a Lindberg furnace having a mullite tube in which the aerosol is heated. The pressure is monitored by gauge 11 between generator 7 and reactor 13. The temperature of the heated aerosol is measured by thermocouple 15 and the aerosol is passed to heated filter 17. The carrier gas and volatilization products from the decomposition reaction in the furnace are then discharged from the downstream side of the filter 17.

In carrying out the test operations described below, a pressurized carrier gas was directed through the aerosol generator, which then forced the aerosol through a heated reactor. The aerosol droplets were dried, reacted and densified in the furnace and the resulting finely divided metal or metal oxide particles were collected on a filter. A thermocouple at the filter indicated its temperature, which was maintained at about 60C to prevent water condensation at the filter. A pressure gauge was maintained upstream of the reactor to indicate any sudden rise in the pressure due to clogging of the filter. The carrier gas was initially air, but ultra-high purity (UHP) nitrogen was also used to reduce the reaction temperature for the formation of pure palladium and/or palladium oxide. Two types of aerosol generators were used to determine the effect of droplet size on the metal particle properties: (1) a modified BGI Collison CN-25 generator and (2) a TSI-3076 constant output atomizer. The reactor temperature was varied between 300 and 950C. The residence times differed as a function of flow rate and reactor temperature and therefore ranged from 14 to 38 seconds. The filter was a nylon membrane filter. The concentrations of aqueous $Pd(NO_3)_2$ in the solution reservoir were 0.5 and 1.9 moles/L.

Thirteen process runs were performed in which the method of the invention was demonstrated. The operating conditions of these runs are shown in Table 1 below, along with selected properties of the palladium and palladium oxide particles produced therefrom.

TABLE 1

Test Data

| Example No. | 1 | 2 | 3 | 4 | 5 |
|---|---|---|---|---|---|
| Furnace Temperature (°C.) | 300 | 400 | 500 | 600 | 700 |
| Carrier Gas | Air | Air | Air | Air | Air |
| Type of Aerosol Generator | TSI[1] | TSI | TSI | TSI | TSI |
| Pd Concentration (moles/L) | 0.5 | 0.5 | 0.5 | 0.5 | 0.5 |
| Flow Rate (L/min) | 1.7 | 1.7 | 1.7 | 1.7 | 1.7 |
| Residence Time (sec) | 38 | 32 | 28 | 25 | 22 |
| Surface Area ($m^2/g$) | 7.68 | 56.4 | 32.1 | 9.26 | 4.73 |
| Weight Loss at 300° C. (%) | 16 | 1 | 0 | 0 | 0 |
| X-Ray Diffraction | PdO Broad Peaks | PdO | PdO | PdO | PdO Narrow Peaks |

| Example No. | 6 | 7 | 8 | 9 | 10 |
|---|---|---|---|---|---|
| Furnace Temperature (°C.) | 800 | 900 | 950 | 500 | 600 |
| Carrier Gas | Air | Air | Air | $N_2$ | $N_2$ |
| Type of Aerosol Generator | TSI | TSI | TSI | Ultra[2] | Ultra |
| Pd Concentration (moles/L) | 0.5 | 0.5 | 0.5 | 1.9 | 1.9 |
| Flow Rate (L/min) | 1.7 | 1.7 | 1.7 | 6.65 | 6.65 |
| Residence Time (sec) | 20 | 19 | 18 | 21 | 19 |
| Surface Area ($m^2/g$) | 3.22 | 2.53 | 3.28 | 32 | — |
| Weight Loss at 300°C. (%) | 0 | 0 | 0 | 0 | 0 |
| X-Ray Diffraction | PdO + Trace Pd | Pd Narrow Peaks | Pd Narrow Peaks | PdO Broad Peaks | PdO |

TABLE 1-continued

| Test Data | | | |
|---|---|---|---|
| Example No. | 11 | 12 | 13 |
| Furnace Temperature (°C.) | 700 | 800 | 900 |
| Carrier Gas | $N_2$ | $N_2$ | $N_2$ |
| Type of Aerosol Generator | Ultra | Ultra | Ultra |
| Pd Concentration (moles/L) | 1.9 | 1.9 | 1.9 |
| Flow Rate (L/min) | 6.65 | 6.65 | 6.65 |
| Residence Time (sec) | 17 | 15 | 14 |
| Surface Area ($m^2/g$) | — | — | 1.78 |
| Weight Loss at 300°C. (%) | 0 | 0 | 0 |
| X-Ray Diffraction | PdO | Pd Narrow Peaks | Pd Narrow Peaks |

Figure 2A:
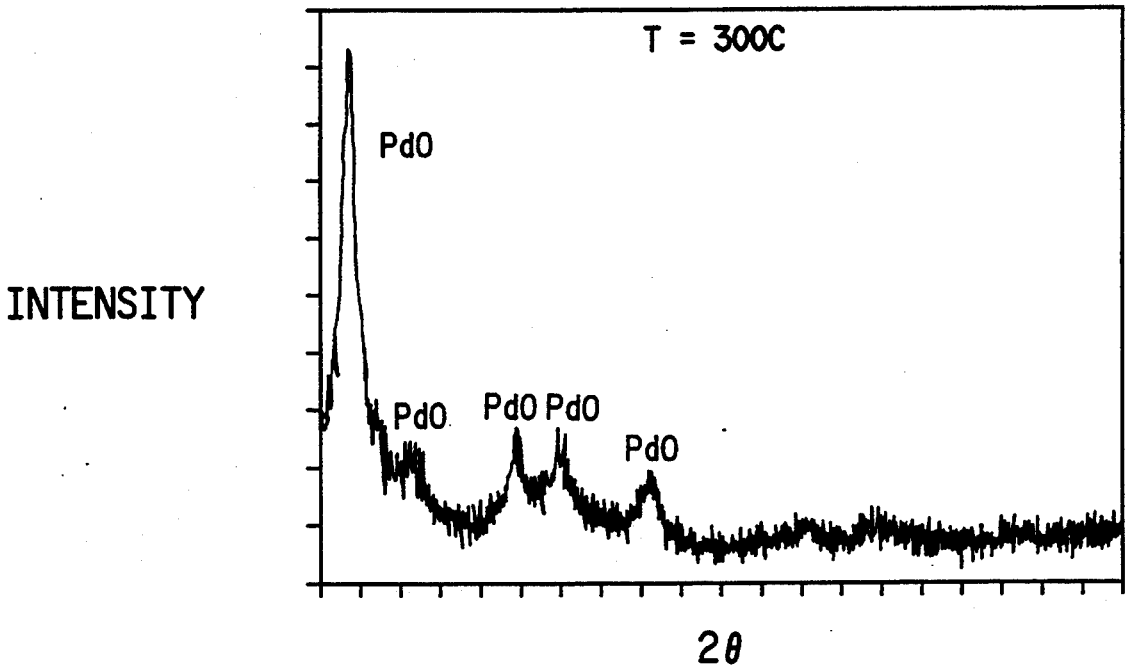
FIGS. 2*a*, 2*b*, 2*c*, 4*a*, 4*b*, 5*a* and 5*b* x-ray diffraction patterns of products made by the use of the invention
Figure 2B:
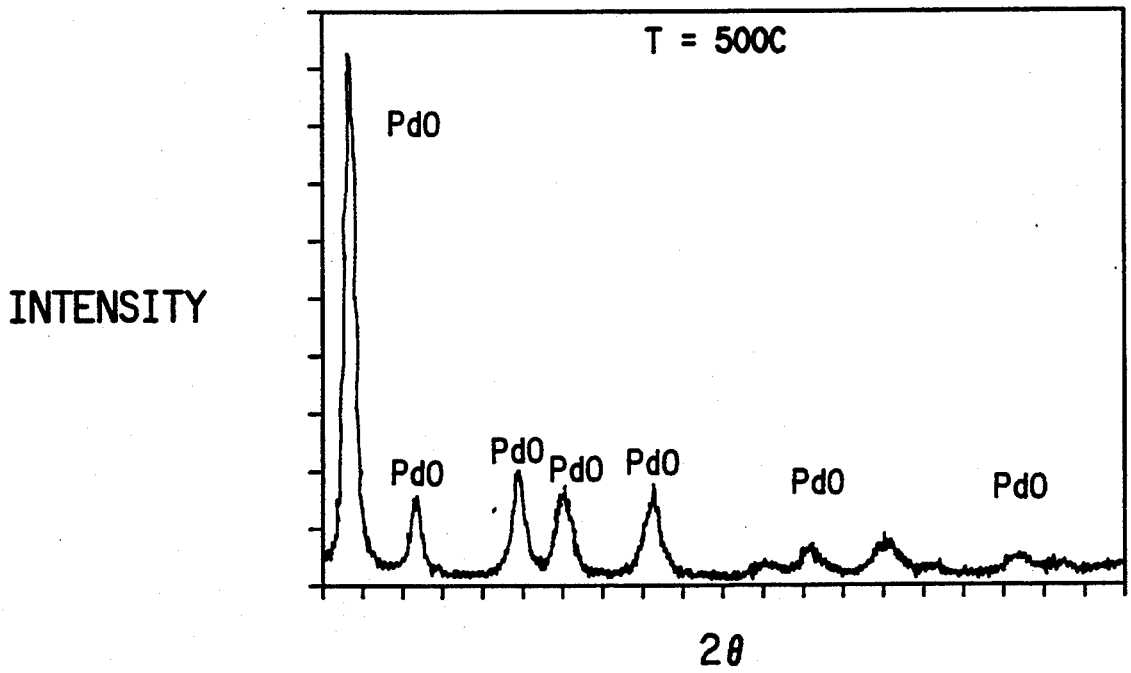
Figure 2C:
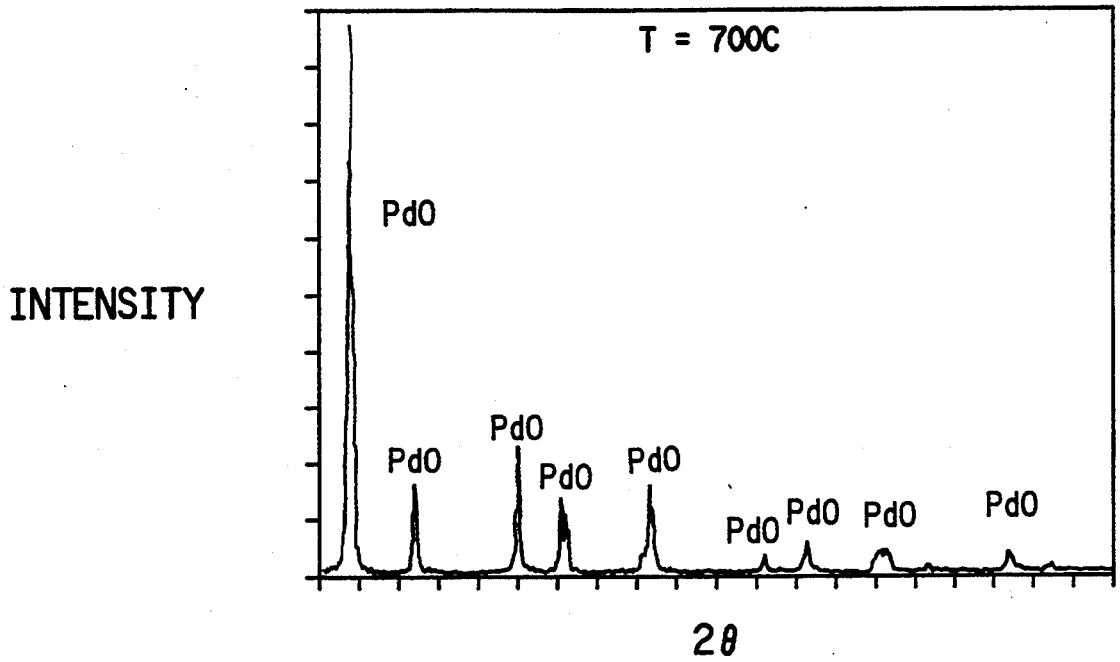

[1]TSI-3076 constant output atomizer
[2]Modified ultrasonic Pollenex home humidifier The weight loss data from Examples 1–7 show that, when using air as the carrier gas, pure PdO was obtained when the operating temperature exceeds about 500C. The narrowing of the peaks in the X-ray diffraction patterns for the product produced in Examples 1, 3 and 5 (FIGS. 1*a*, 1*b* and 1*c* respectively) show that, as the temperature was increased to 700C, the PdO became densified. This is also indicated by the decreasing surface area of the PdO particles. (See FIG. 2)

Figure 3:
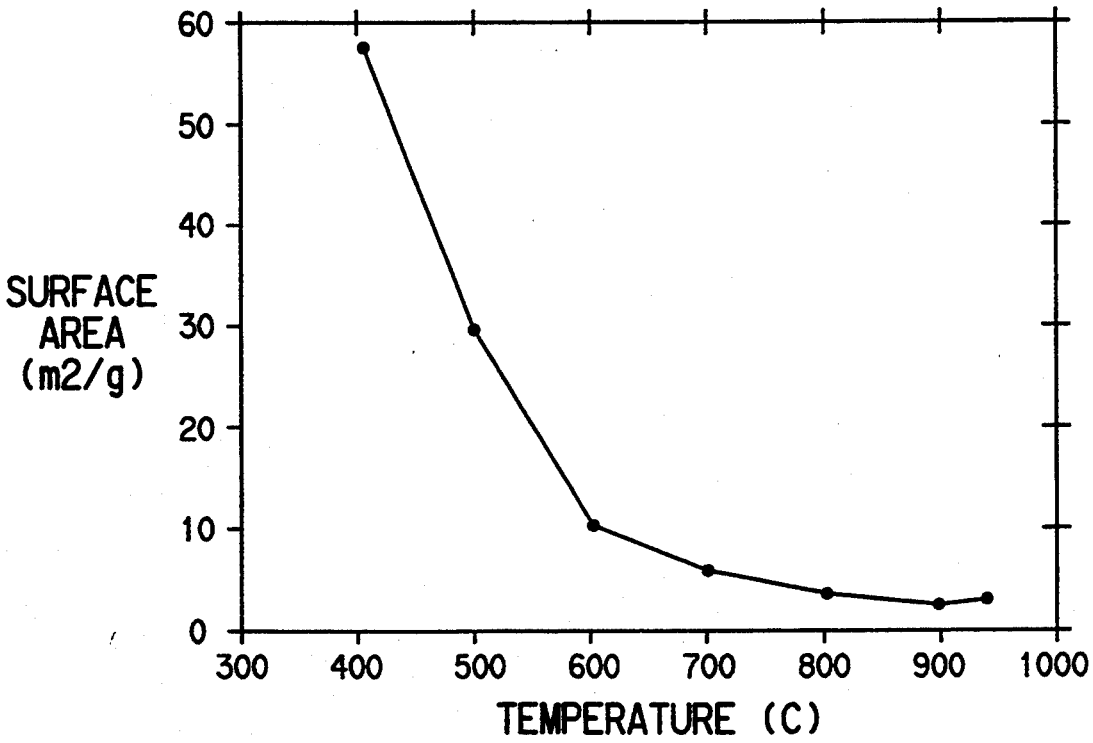
FIG. 3 is a graphical representation of effect of operating temperature upon particle surface area.

The X-ray diffraction peaks of the products from Example 6 show that below the decomposition temperature of PdO (870C), quite pure particles of PdO were produced. On the other hand, when the operating temperature exceeds about 900C, pure crystalline Pd metal was produced as shown by the X-ray diffraction pattern for Example 7. (See FIG. 3*a* and 3*b*)

Examination of the particles produced from Example 3 by transmission electron microscopy (TEM) indicated that the PdO particles were comprised of many small nano-sized crystallites within each particle. Examination of the particles from Example 7 showed that the Pd metal particles were each single crystals.

Figure 4A:
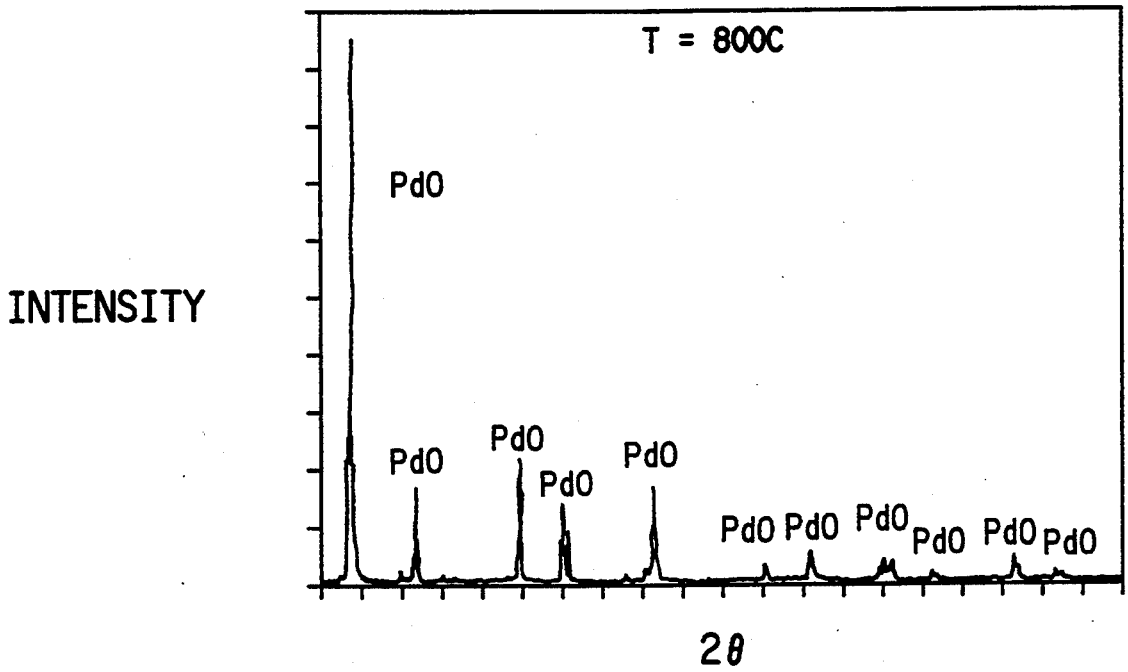
Figure 4B:
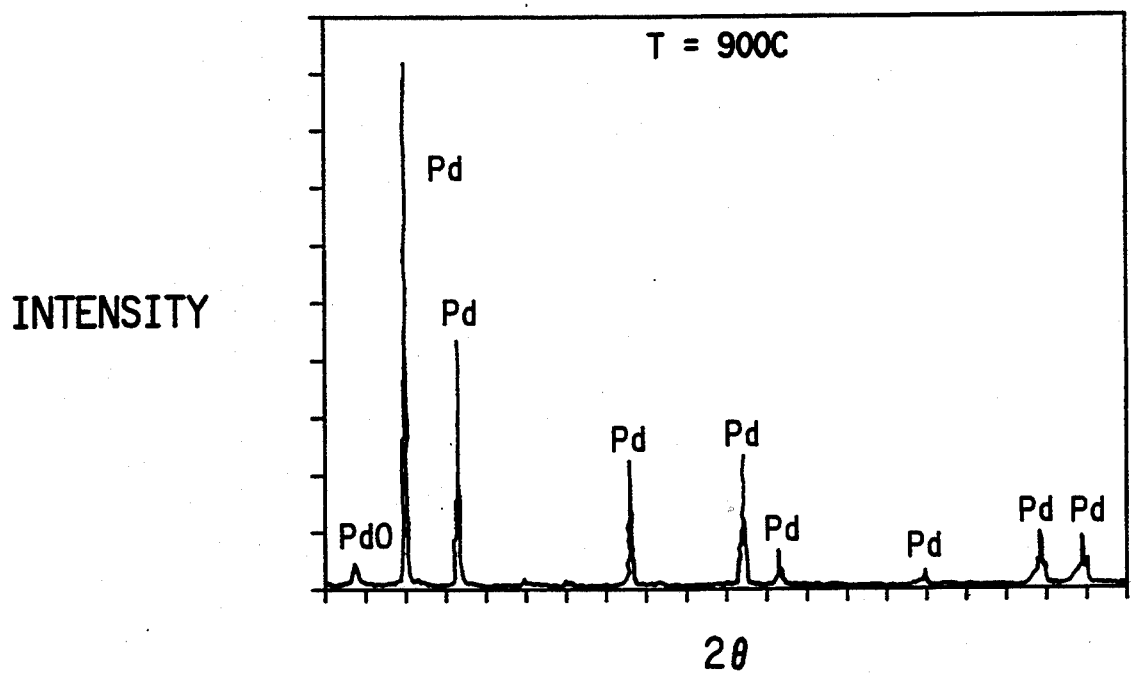
Figure 5A:
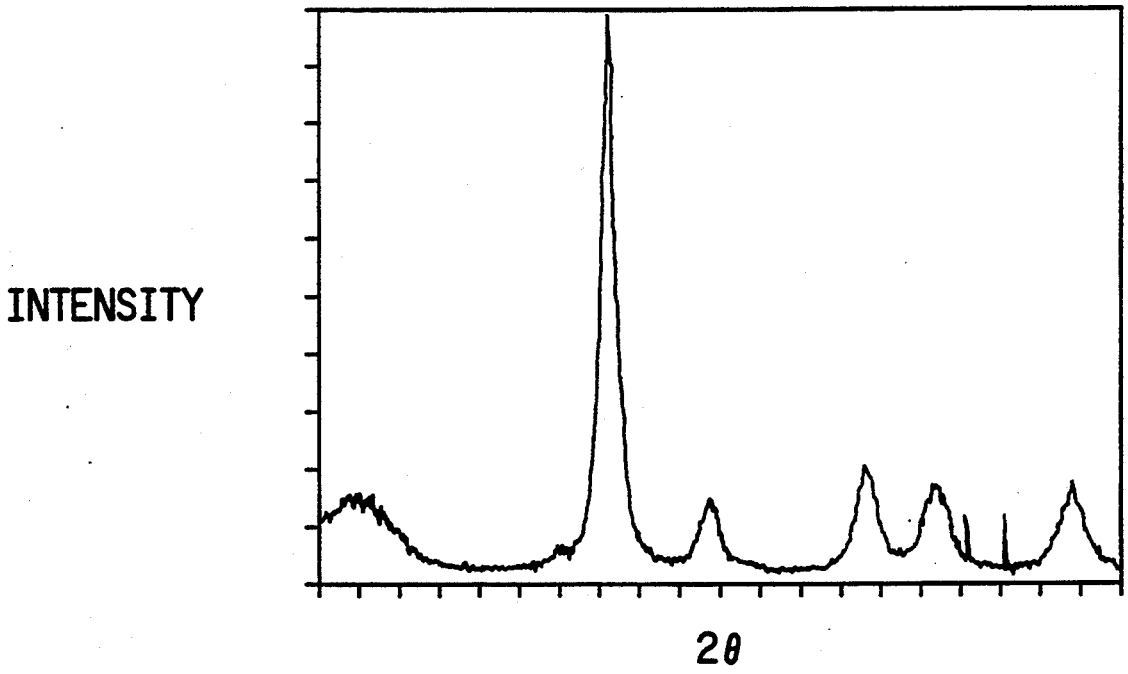
Figure 5B:
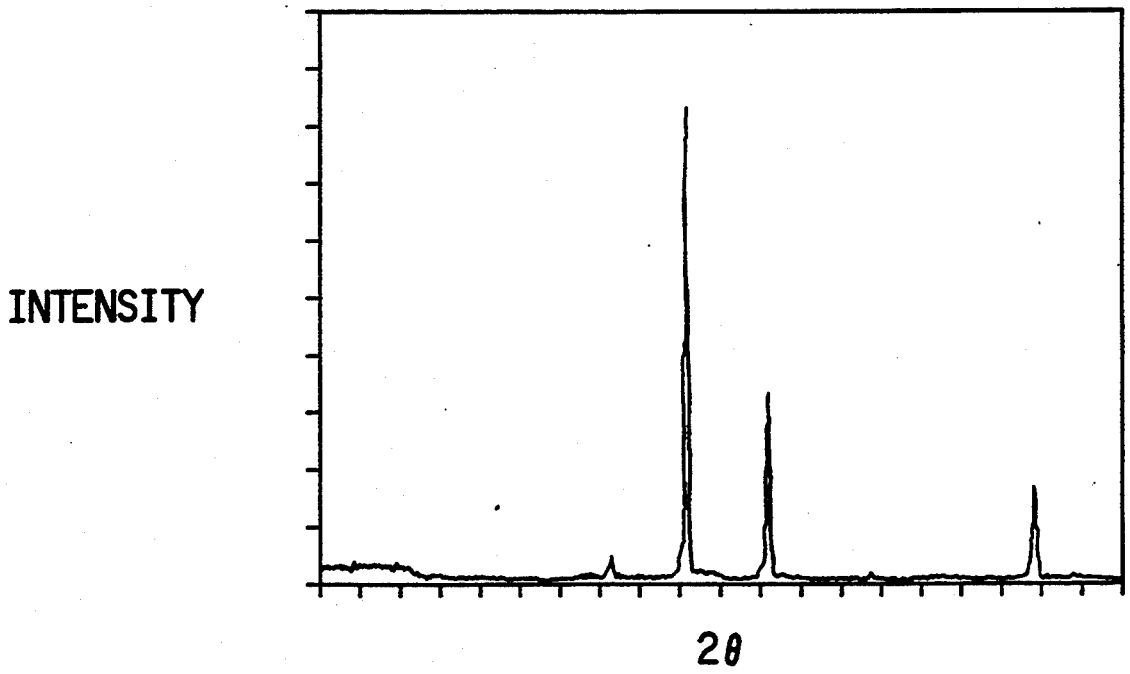

Looking at Examples 9–13 in which $N_2$ was used as the carrier gas, PdO particles were produced when operating at 500–700C and at 800C and higher, pure crystalline, dense particles of Pd metal were produced. The broad peaks of the X-ray diffraction pattern of Example 9 (FIG. 4*a*) indicate that the PdO consists of many small crystallites. On the other hand, the narrow peaks of the X-ray diffraction pattern of Example 12 (FIG. 4*b*) indicate that the Pd metal is quite pure and consists of single crystals rather than an agglomerate of many crystals. This observation leads to the conclusion that as the PdO particles are heated, the crystallites coalesce and, upon decomposition to Pd metal, the particles densify to form single crystals.

Examination by scanning electron microscopy (SEM) of the particulate products produced in accordance with the invention (Examples 2–13) showed that the particles were both dense and spherical.

The above data show that the method of the invention provides a very desirable alternative to the prior art methods for making PdO and metal particles. Palladium oxide powders made by the aerosol decomposition method of the invention are pure, dense, unagglomerated, spherical and have a controlled size which is dependent on the aerosol generator used and the concentration of the salt solution. Palladium oxide powders made by the method invention do not have the irregular shape, low density and agglomeration of particles produced by solution hydrolysis or air oxidation.

Palladium powders made by the aerosol decomposition method of the invention are pure, dense, unagglomerated, spherical and have a controlled size dependent on the aerosol generator and the concentration of the salt solution. Palladium powders made by the invention do not have the impurities, irregular shape and agglomeration commonly found in palladium particles produced by solution precipitation. Furthermore, fully reacted and densified palladium particles were produced at temperatures significantly below the melting point of palladium.

From experience with the method of the invention, it is believed that palladium particles are formed in accordance with the following sequence when the reaction system is based on aqueous $Pd(NO_3)_2$ and the carrier gas is air:

(1) As the aerosol is heated above the evaporation temperature of the solvent, the solvent is evaporated from the aerosol droplets thus forming porous particles of $Pd(NO_3)_2$;

(2) As the porous $Pd(NO_3)_2$ particles are heated further, they are decomposed to form porous palladium oxide particles which then become densified and crystalline;

(3) Continuing to increase the temperature, the dense crystalline PdO particles decompose to form porous Pd metal particles; and (4) During the remainder of the residence time within the reactor furnace, the porous palladium particles become fully densified and crystalline.

We claim:

1. A method for the manufacture of finely divided, substantially fully dense, spherical particles of palladium oxide comprising the sequential steps:

A. Forming an unsaturated solution of thermally decomposable palladium-containing compound in a thermally volatilizable solvent;

B. Forming an aerosol consisting essentially of finely divided droplets of the solution from step A dispersed in an inert carrier gas, the droplet concentration being below the concentration where collisions and subsequent coalescence of the droplets result in a 10% reduction in droplet concentration during the reaction residence time of the following step C.;

C. Heating the aerosol to an operating temperature above the decomposition temperature of said palladium-containing compound, thereby volatilizing the solvent and decompassing the palladium containing compound to form finely divided, spherical particles of palladium oxide, further heating to equal or greater than the densification temperature of the palladium oxide particle, but below the decomposition temperature of palladium oxide by which the palladium oxide particles are densified; and D. Separating the finely divided, substantially fully dense, spherical palladium oxide particles from the carrier gas, decomposition by-products and solvent volatilization products.

2. The method of claim 1 in which the carrier gas is air and the aerosol is heated to a temperature of 700°–850° C.

3. The method of claim 1 in which the carrier gas is $N_2$ and the aerosol is heated to a temperature of 600°–700° C.

4. A method for the manufacture of finely divided, substantially fully dense, spherical particles of palladium, comprising the sequential steps:

A. Forming an unsaturated solution of thermally decomposable palladium-containing compound in a thermally volatilizable solvent;

B. Forming an aerosol consisting essentially of finely divided droplets of the solution from step A dispersed in an inert carrier gas, the droplet concentration being below the concentration where collisions and subsequent coalescence of the droplets result in a 10% reduction in droplet concentration during the reaction residence time of the following step C;

C. Heating the aerosol to an operating temperature above the decomposition temperature of the palladium-containing compound, thereby volatilizing the solvent and decomposing the palladium-containing compound to form finely divided, spherical particles of palladium oxide, heating the palladium oxide above its decomposition temperature producing finely divided spherical particles of Pd, further heating to equal or greater than the densification temperature of the palladium particles, but below the melting point of palladium by which the palladium particles are densified and made crystalline; and D. Separating the finely divided, substantially fully dense, spherical particles of palladium from the carrier gas, decomposition by-products and solvent volatilization products.

5. The method of claim 4 in which the carrier gas is air and the aerosol is heated to a temperature above 900° C.

6. The method of claim 4 in which the carrier gas is $N_2$ and the aerosol is heated to a temperature above 800° C.

7. The method of claims 1 or 4 in which the palladium-containing compound is $Pd(NO_3)_2$.

8. The method of claims 1 or 4 in which the thermally volatilizable solvent is deionized water.

* * * * *